US008652225B2

(12) United States Patent
MacKay

(10) Patent No.: US 8,652,225 B2
(45) Date of Patent: Feb. 18, 2014

(54) FLEXIBLE COATED ABRASIVE FINISHING ARTICLE AND METHOD OF MANUFACTURING THE SAME

(76) Inventor: Joseph H. MacKay, San Diego, CA (US)

( * ) Notice: Subject to any disclaimer, the term of this patent is extended or adjusted under 35 U.S.C. 154(b) by 775 days.

(21) Appl. No.: 12/837,851

(22) Filed: Jul. 16, 2010

(65) Prior Publication Data

US 2011/0021122 A1 Jan. 27, 2011

Related U.S. Application Data

(60) Provisional application No. 61/271,771, filed on Jul. 27, 2009.

(51) Int. Cl.
*B24D 11/00* (2006.01)

(52) U.S. Cl.
USPC ..... 51/297; 51/295; 451/28; 451/539

(58) Field of Classification Search
None
See application file for complete search history.

(56) References Cited

U.S. PATENT DOCUMENTS

| | | | | |
|---|---|---|---|---|
| 6,942,554 | B1 * | 9/2005 | Mandina | 451/165 |
| 7,344,575 | B2 * | 3/2008 | Thurber et al. | 51/298 |
| 2003/0017357 | A1 * | 1/2003 | Steiner et al. | 428/626 |
| 2003/0068534 | A1 * | 4/2003 | Ohkawa et al. | 428/701 |
| 2003/0164222 | A1 * | 9/2003 | Kneafsey et al. | 156/314 |
| 2003/0175498 | A1 * | 9/2003 | Hunt et al. | 428/323 |
| 2003/0228836 | A1 * | 12/2003 | Lombardo et al. | 451/533 |
| 2004/0048057 | A1 * | 3/2004 | Kendall | 428/323 |
| 2004/0212269 | A1 * | 10/2004 | Decristofaro et al. | 310/216 |
| 2005/0182443 | A1 * | 8/2005 | Jonn et al. | 606/213 |
| 2006/0060472 | A1 * | 3/2006 | Tomita et al. | 205/112 |
| 2007/0137784 | A1 * | 6/2007 | McDonnell et al. | 156/293 |
| 2008/0287574 | A1 * | 11/2008 | Loth et al. | 524/35 |

OTHER PUBLICATIONS

Chemical Book, "2-methoxyethyl 2-cyanoacrylate", CAS No. 27816-23-5, http://www.chemicalbook.com/ChemicalProductProperty_EN_CB5941944.htm (Apr. 2013).*

Loctite Corporation, Material Safety Data Sheet for beta-methoxyethyl cyanoacrylate, CAS No. 27816-23-5 (Aug. 2005).*

* cited by examiner

*Primary Examiner* — Kaj K Olsen
*Assistant Examiner* — Ross J Christie
(74) *Attorney, Agent, or Firm* — Novak Druce Connolly Bove + Quigg LLP

(57) ABSTRACT

A flexible abrasive finishing article including a backing of fabric or paper having first and second major surfaces with abrasive particles adhesively secured to said first major surface and a layer of cyanoacrylate based material substantially covering the second major surface. The method of making a flexible abrasive finishing material including the steps of applying a layer of cyanoacrylate based material to a surface of a backing material opposite the surface to which abrasive particles are adhesively secured and covering said cyanoacrylate material.

16 Claims, 3 Drawing Sheets

FLEXIBLE COATED ABRASIVE FINISHING ARTICLE AND METHOD OF MANUFACTURING THE SAME

RELATED APPLICATIONS

This application is based upon Provisional Patent Application No. 61/271,771 filed on Jul. 27, 2009, Reinforcing Cloth & Paper Abrasive Discs with Cyanoacrylate Adhesive, and hereby claims the benefit of the filing date thereof.

FIELD OF THE INVENTION

The present invention relates generally to flexible abrasive products having a backing material of fabric or paper having abrasive particles adhered to one surface thereof and a layer of cyanoacrylate based material coated on the opposite surface thereof.

BACKGROUND OF THE INVENTION

Coated abrasive articles generally contain an abrasive material typically in the form of abrasive grains bonded to a backing by means of one or more adhesive layers. Such articles usually take the form of sheets, discs, belts, bands and the like which can be adapted to be mounted on pulleys, wheels or drums. Abrasive articles can be used for sanding, grinding or polishing various surfaces of, for example only, and not by way of limitation, steel and other metals, wood, wood-like laminates, plastic, fiberglass, leather or ceramics.

Coated abrasive articles are used industrially, commercially and by individual consumers to prepare any of a variety of materials for use or for further processing. Exemplary uses of such abrasive products include: preliminary preparation of a surface before priming or painting, cleaning the surface of an object to remove oxidation or debris, and grinding or abraiding an object to obtain a specific shape, to upbraid a surface to clean or facilitate a bonding or coating such as paint, or to provide a desired surface finish especially a smooth or otherwise a decorative finish.

Many abrasive articles are used as discs in grinding assemblies. A typical such abrasive, sanding or grinding assembly includes: a back-up pad or support pad made from a resilient and reinforced material such as rubber or plastic, an abrasive disc which is typically adhesively or hook and loop mounted on the back-up pad, or otherwise secured by appropriate fastening members attached to the abrasive disc, and a rotatable shaft and cap for mounting the abrasive disc and back-up pad to an appropriate electric or air pressure driven power tool. In use, the shaft of the assembly is rotated by the power tool and the abrasive coated surface of the disc is pressed against a work piece with considerable force, thus the disc is subjected to severe stresses.

The backings used in coated abrasive articles are typically made of paper, polymeric materials, cloth, non-woven materials, vulcanized fiber, or combinations of these materials. Many of these materials are not appropriate for certain applications because they are not of sufficient strength, flexibility or impact resistant.

The present invention is directed to coated abrasive finishing articles which utilize fabric or paper as the backing material. Such backing materials when utilized as coated abrasive discs used in a grinding operation such as: weld grinding, contour grinding, and edge grinding it has been found that the backing material, particularly around the outer edges of the disc, tends to deteriorate rather rapidly thus causing a very short useful life for the abrasive disc. The deterioration and short life is contributed to by the limited radial strength of the fabric and/or paper backing In many instances coated abrasive finishing articles have an additional coating or layer applied to the surface of the backing material opposite that to which the abrasive articles are secured in order to provide additional lifetime to the coated abrasive disc. It has, however, been found that when such additional coating or laminations are applied to the surface of the backing material that the flexibility of the abrasive disc is compromised. That, therefore, results in the inability of the operator to utilize the abrasive disc to abrasively finish surfaces which have curvatures thereto of any significant degree.

Thus there exists a need for a flexible abrasive finishing article which has a tailored cutting ability, a long useful life which can be made in a simple method and does not in anyway compromise the flexibility of the abrasive finishing article. Particularly, such abrasive finishing articles are formed as discs.

SUMMARY OF THE INVENTION

A flexible coated abrasive finishing article having a flexible backing having first and second major surfaces, an abrasive layer secured to the first major surface, and a layer of cyanoacrylate based material substantially covering said second major surface.

The present invention also includes the method of making a flexible coated abrasive article which includes the steps of providing a flexible backing having first and second major surfaces on opposite sides thereof, an abrasive layer secured to the first major surface, and applying a coating of cyanoacrylate based material to such second major surface, and curing said cyanoacrylate material to provide a coating substantially covering said second major surface.

BRIEF DESCRIPTION OF THE DRAWINGS

FIG. 1 is schematic in nature to reflect construction according to the present invention;

DETAILED DESCRIPTION OF THE INVENTION

As required, detailed descriptions of the present invention are provided herein. In general, the detailed descriptions are to be considered as exemplary only. Therefore the invention is not to be interpreted as limited to the specific formulations, arrangements and method identified and described, except as limited by the claims.

Figure 1:
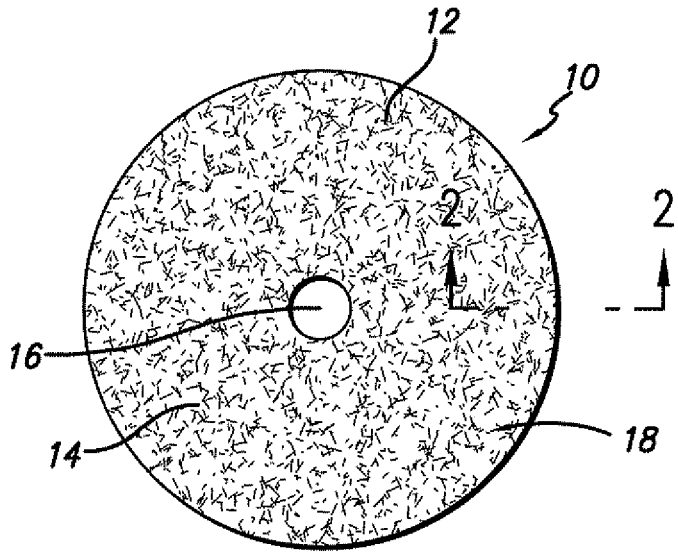
FIG. 1 is a front view of a coated abrasive article according to the present invention.
Figure 2:
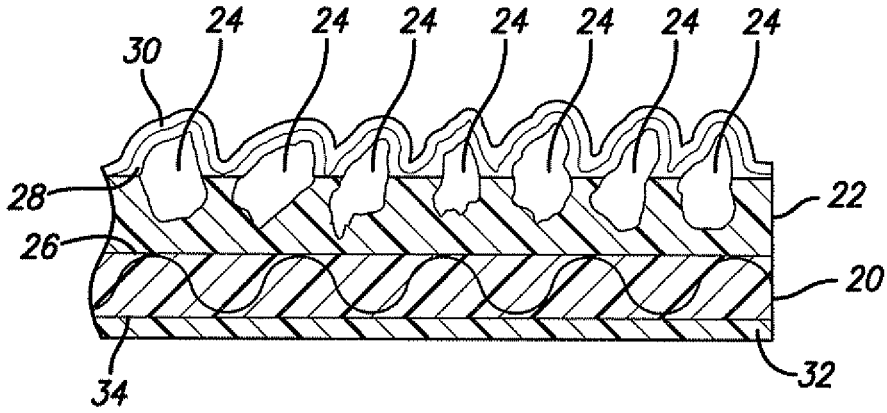
FIG. 2 is an enlarged fragmentary side cross-sectional view of a coated abrasive article according to the present invention taken along the lines 2-2 of FIG. 1.

FIG. 1 illustrates a front view of a circular disc 10 which incorporates the construction as illustrated in FIG. 2. Circular disc 10 is representative of a working surface 12 of a coated abrasive disc according to the present invention. The working surface 12 is also referred to as a front surface or a top surface and generally represents the surface used for abraiding work pieces. The representation shows two general regions 14 and 16. Region 14 includes abrasive material in the form of abrasive grains 18 adhered to the working surface 12 of the backing of the circular disc 10. Region 16 is a center aperture in the circular disc 10 for use in mounting the disc 10 on a rotatable shaft of a power driven grinding tool for rapidly rotating the disc 10 as the working surface 12 is applied to the surface which is to be abrasively finished. It will be understood by those skilled in the art that various attachments may be used which may or may not require a center aperture.

Generally the diameter of the disc will be within the size range of about two to six inches but can vary therefrom. The disc may typically have a center aperture as illustrated, that is the region 16 which is usually about ¼ to ⅞ inches in diameter. Alternatively, however, instead of having a center aperture as illustrated at 16 there may be affixed to the reverse or backside of the disc 10 an attachment system which is utilized for attaching the disc 10 to an appropriate power drive tool such as a random orbit dual action sander.

Referring now more particularly to FIG. 2, a coated abrasive article 10 according to the present invention includes a backing 20 and a layer 22 of adhesive material. This adhesive material 22 is used to secure an abrasive material such as a plurality of abrasive grains 24 to the working or first major surface 26 of the backing 20. The layer of adhesive 22 is commonly referred to as a make coat. A second adhesive layer 28 which is commonly referred to as a size coat is coated over the abrasive grains 24 and the first adhesive layer 22. The purpose of the size coat is to secure and anchor the abrasive grains 24. A third adhesive layer 30 which is commonly referred to as a supersize coat may be coated over the second adhesive layer 28. The third adhesive layer 30 is optional and is typically utilized in coated abrasive articles that abraid very hard surfaces such as stainless steel or exotic metal work pieces.

The thickness of the backing layer 20 is typically less than about 0.06 inches for optimum flexibility and material conservation. Preferably the thickness of the backing 22 is between about 0.02 and 0.05 inches for optimum flexibility. However, the thickness of the backing layer 20 may be decreased or increased depending upon the particular applicability to which the abrasive finishing article is to be put. As is illustrated in FIG. 2, the backing layer 20 is constructed of fabric material both natural and synthetic. It should be understood, however, and will be discussed more in detail hereinafter that the backing layer may also be constructed of paper.

The structure above described and illustrated is known in the art and for example, one form thereof is illustrated and described in U.S. Pat. No. 7,344,575 which is incorporated herein by reference.

The novel feature of the present invention is that a layer of cyanoacrylate based material 32 is adhered to the opposite or second major surface 34 of the backing material 20, that is the major surface opposing the first major surface 26 to which the abrasive particles 24 are secured. The thickness of the layer 32 of cyanoacrylate based material is preferably between 0.003 and 0.005 inches although it may be thicker depending upon the particular application to which the abrasive finishing article is to be put. It has been found that the layer of cyanoacrylate based material provides a surprising improvement to the radial strength of the backing material 20 without any loss of flexibility. Such surprising improved radial strength permits the use of larger diameter abrasive discs held on support pads with relatively small diameter fastener flanges. The support pads can be very flexible if desired. It is this improved radial strength of the backing material provided by the cyanoacrylate based layer that allows the utilization of such discs on random orbit/dual action sanders for abrasively finishing contours as well as flat surfaces. The cyanoacrylate coating increases the radial strength such that the periphery of the adhesive disc does not deteriorate for a substantially longer use period even under severe stress.

The cyanoacrylate based layer 32 may be any known cyanoacrylate based material. However, it is preferably selected from the group consisting of ethyl cyanoacrylate, methyl cyanoacrylate, butyl cyanoacrylate, beta methoxy ethyl cyanoacrylate, alpha cyanoacrylate, and octyl cyanoacrylate.

Figure 3:
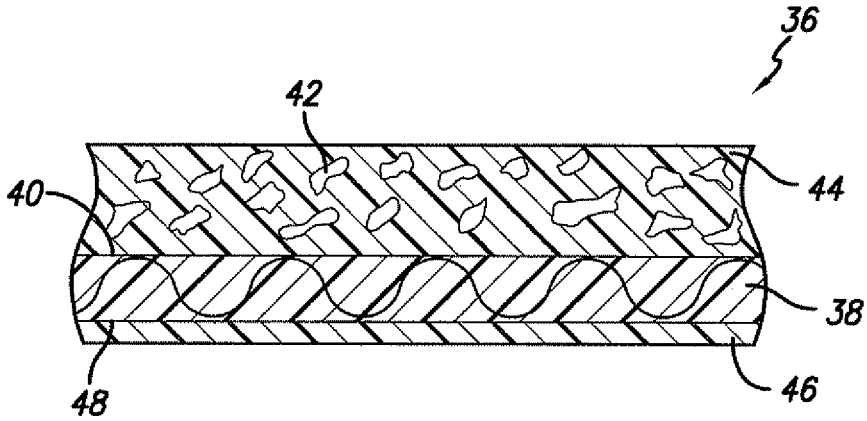
FIG. 3 is an enlarged fragmentary side cross-sectional view of an alternative embodiment of a coated abrasive article according to the present invention.

Referring now more particularly to FIG. 3, another exemplary coated abrasive article according to the present invention is illustrated. As is therein shown, the coated abrasive article 36 comprises a backing 38. The backing 38 may be fabric as is the backing 20 in FIG. 2, or alternatively, as will be described in more detail hereinafter, may also be paper. Adhered to the working surface 40 of the backing 38 is a plurality of abrasive grits such as shown at 42 which are distributed throughout a binder 44. Again, structure as thus illustrated and described is well known in the prior art and described in U.S. Pat. No. 7,344,575 above referred to and is incorporated herein by this reference. In accordance with the novel feature of the present invention, a layer 46 of cyanoacrylate based material selected from the group above identified is secured to the opposite surface 48 of the backing layer 38 and is constructed of the materials and of the thicknesses as above described.

Figure 4:
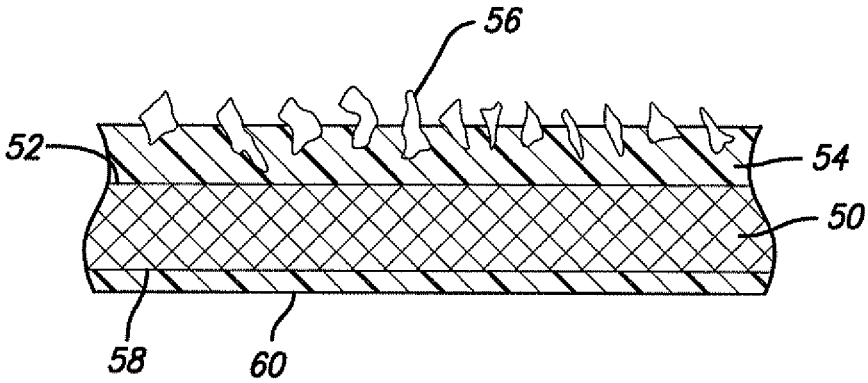
FIG. 4 is an enlarged fragmentary side cross-sectional view of a further embodiment of a coated abrasive article according to the present invention.

Referring now more particularly to FIG. 4, there is illustrated an additional embodiment of the present invention which includes a backing layer 50 which is constructed of paper. Attached to the working or first major surface 52 of the paper backing layer 50 is an adhesive layer 54 which is used to secure a plurality of abrasive particles 56 to the working surface 52 of the paper backing 50. On the opposite or second major surface 58 of the backing layer 50 there is adhered a layer 60 of cyanoacrylate material of the type above referred to and selected from the group above referred to. Again the layer 60 of cyanoacrylate based material provides surprisingly improved radial strength to the paper backing layer 50 allowing it to be used in the manner above described in accordance with the surprising results obtained by the present invention.

Figure 6:
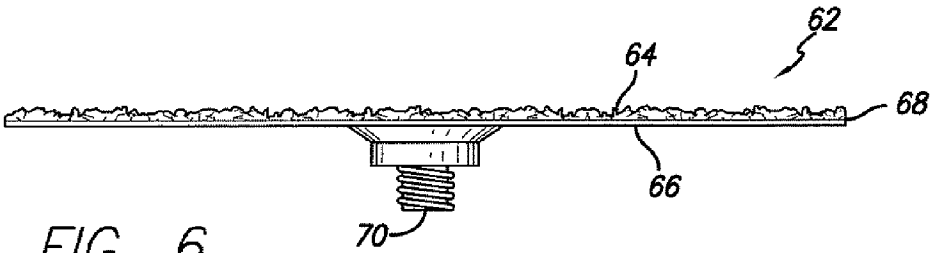
FIG. 6 is a schematic view of a system for making coated abrasive material to be used in constructing coated abrasive finishing articles as illustrated in FIGS. 1 through 5.

Referring now more particularly to FIG. 6, there is illustrated an abrasive disc 62 having the abrasive particles 64 secured to the working surface thereof and a layer of cyanoacrylate based material 66 secured the opposite surface of a backing layer 68 and extending to the peripheral edge thereof. Also secured to an opposite surface of the backing material 68 is a securing system 70 which is well known in the art and is utilized to secure the disc 62 to an appropriate power tool for rotating the disc as it is applied to a work surface. Alternatively these securing systems may include an appropriate threaded member extending through an aperture in the disc and secured in place by various means known in the art.

Figure 5:
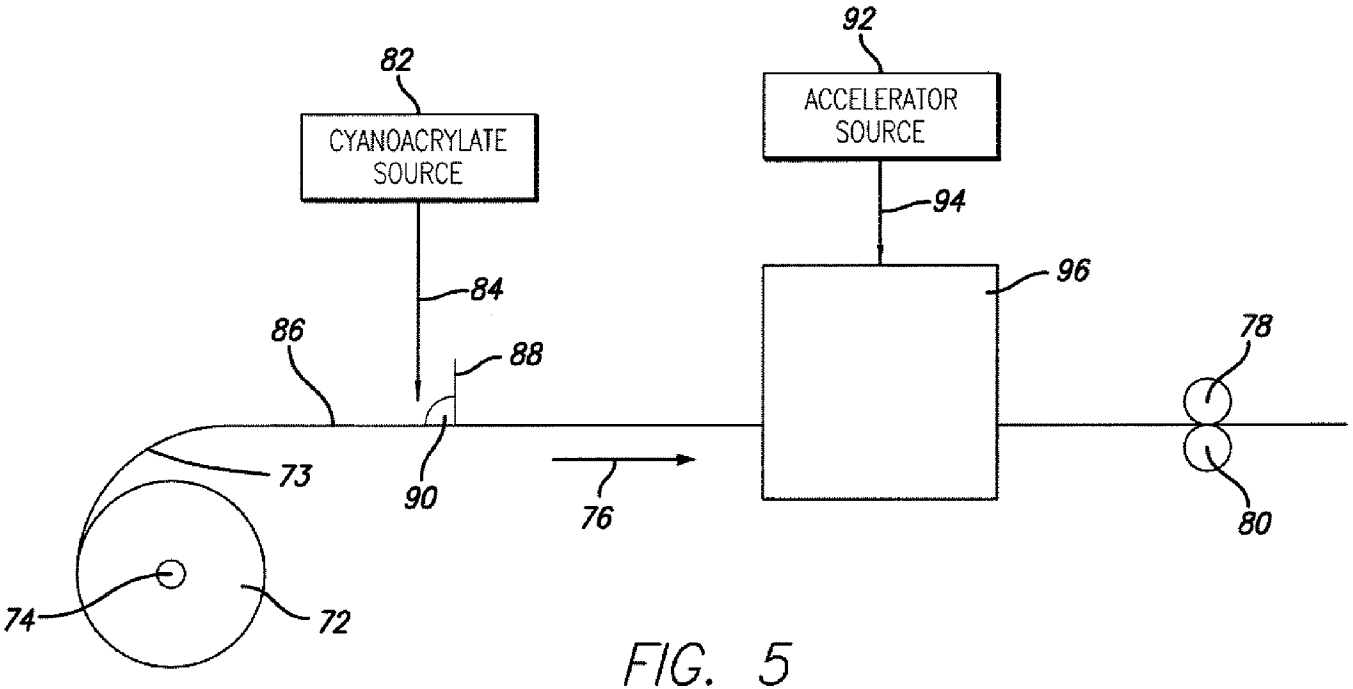
FIG. 5 is a side view of a coated abrasive article according to the present invention and attachment system secured to the back surface thereof.

Referring now more particularly to FIG. 5, there is schematically illustrated a system for constructing the abrasive finishing materials from which the disc as illustrated and described above is manufactured. As is illustrated in FIG. 5 a roll 72 of a backing layer of either fabric or paper having abrasive material adhesively secured to a first major surface 73 thereof is supported upon a support 74 so that the backing material may be pulled in the direction shown by the arrow 76 by appropriate rotating rollers 78 and 80 which grip the material and pulls it from the roll 72. As the material is pulled in the direction as shown by the arrow 76 a cyanoacrylate based material is deposited from a source 82 thereof through an appropriate conduit 84 onto a second major surface 86 of the backing layer opposite that material. After the cyanoacrylate material is deposited on the surface a scraper 88 spreads the material and evens it out as is shown at 90. The scraper is preferably manufactured from ultra high molecular weight (UHMW) polyethylene plastic material. As is well known in the art the cyanoacrylate material will cure and set very rapidly and particularly such is the case in the presence of moisture. However, to speed up the manufacturing process an accelerator is applied to the surface 86 of the material upon which the cyanoacrylate based material has been deposited. This accelerator is applied from a source 92 thereof through an appropriate conduit 94 into a chamber 96 through which the backing material having the cyanoacrylate coated thereon is passed. The accelerator which is utilized may be any known to the art, but preferably is toluidine which is disposed within a carrier such as acetone or isopropyl alcohol and one such carrier may be 68% acetone, 14% N butane and 15% propane. Through the utilization of the accelerator the cyanoacrylate based material cures much more rapidly such that by the time it reaches the rollers 78 and 80 the cyanoacrylate is totally cured and no longer has an adhesive-like characteristic.

There has thus been disclosed a flexible coated abrasive finishing article having a fabric or paper backing which has abrasive articles affixed to a first major surface thereof and layer of cyanoacrylate based material affixed to the opposite or second major surface thereof which provides surprisingly improved radial strength to the coated abrasive finishing article, as well as a method of manufacturing the same.

What is claimed is:

1. A flexible coated abrasive finishing article consisting of:
- a flexible single layer backing of fabric or paper having first and second major surfaces and a peripheral edge;
- an abrasive layer secured to said first major surface; and
- a layer of cured cyanoacrylate based material substantially covering said second major surface and extending to the peripheral edge thereof.

2. The coated abrasive finishing article as defined in claim 1 wherein said cyanoacrylate based material is selected from the group consisting of ethyl cyanoacrylate, methyl cyanoacrylate, butyl cyanoacrylate, beta methoxy ethyl cyanoacrylate, alpha cyanoacrylate, and octyl cyanoacrylate.

3. The coated abrasive finishing article as defined in claim 1 wherein said cyanoacrylate based material is methyl cyanoacrylate.

4. The coated abrasive finishing article as defined in claim 1 wherein said cyanoacrylate based material is butyl cyanoacrylate.

5. The coated abrasive finishing article as defined in claim 1 wherein said cyanoacrylate based material is beta methoxy ethyl cyanoacrylate.

6. The coated abrasive finishing article as defined in claim 1 wherein said cyanoacrylate based material is alpha cyanoacrylate.

7. The coated abrasive finishing article as defined in claim 1 wherein said cyanoacrylate based material is octyl cyanoacrylate.

8. The coated abrasive finishing article as defined in claim 1 wherein said cyanoacrylate based material is ethyl cyanoacrylate.

9. The coated abrasive finishing article as defined in claim 1 which further includes an attachment system secured thereto.

10. A method of making a flexible coated abrasive finishing material according to claim 1, comprising the steps of:
- providing a flexible backing having first and second major surfaces on opposite sides thereof and an abrasive layer secured to said first major surface;
- applying a coating of cyanoacrylate based material to said second major surface; and
- curing said cyanoacrylate material to provide a coating substantially covering said second major surface.

11. The method of making a flexible coated abrasive finishing material as defined in claim 10 wherein said cyanoacrylate based material selected from the group consisting of ethyl cyanoacrylate, methyl cyanoacrylate, butyl cyanoacrylate, beta methoxy cyanoacrylate, alpha cyanoacrylate, and octyl cyanoacrylate.

12. The method of making a flexible coated abrasive finishing material as defined in claim 10 which further includes the step of spreading the cyanoacrylate material across the second major surface.

13. The method of making a flexible coated abrasive finishing material as defined in claim 12 wherein the step of curing said cyanoacrylate material includes applying an accelerator to said cyanoacrylate material.

14. The method of making a flexible coated abrasive finishing material as defined in claim 13 wherein said accelerator is toluidine in a carrier.

15. The method of making a flexible coated abrasive finishing material as define in claim 14 wherein the carrier includes acetone or isopropyl alcohol.

16. A flexible coated abrasive finishing article consisting of:
- a flexible single layer disc of fabric or paper having a center area, first and second major surfaces and a peripheral edge;
- a layer of abrasive grains secured to said first major surface;
- a layer of cured cyanoacrylate based material covering said second major surface and extending to the peripheral edge thereof; and
- means at said center area for securing said disc on a rotatable shaft of a power driven grinding tool to rapidly rotate the disc as it is applied to a surface to be abraded.

* * * * *